United States Patent [19]

Smith

[11] Patent Number: 4,901,086

[45] Date of Patent: Feb. 13, 1990

[54] LENS/POLARIZER RADOME

[75] Inventor: Keith C. Smith, Santa Barbara, Calif.

[73] Assignee: Raytheon Company, Lexington, Mass.

[21] Appl. No.: 319,848

[22] Filed: Mar. 6, 1989

Related U.S. Application Data

[63] Continuation of Ser. No. 270,450, Nov. 7, 1988, abandoned, Continuation of Ser. No. 103,778, Oct. 2, 1987, abandoned.

[51] Int. Cl.[4] ..... H01Q 15/12

[52] U.S. Cl. ..... 343/909; 343/753; 343/756; 343/872; 343/911 L

[58] Field of Search ..... 343/753, 754, 756, 777, 343/778, 782, 783, 872, 909, 910, 911 R

[56] References Cited

U.S. PATENT DOCUMENTS

| | | | |
|---|---|---|---|
| 3,496,569 | 2/1970 | Alsberg | 343/778 |
| 3,780,374 | 12/1973 | Shibano et al. | 343/911 R |
| 3,886,561 | 5/1975 | Beyer | 343/911 R |
| 4,096,483 | 6/1978 | Bui Hai et al. | 343/909 |
| 4,148,039 | 4/1979 | Lunden | 343/909 |
| 4,187,507 | 2/1980 | Crane et al. | 343/754 |
| 4,220,957 | 9/1980 | Britt | 343/756 |
| 4,479,128 | 10/1984 | Brunner | 343/909 |
| 4,491,845 | 1/1985 | Rothenberg | 343/778 |
| 4,636,198 | 1/1987 | Seavey | 343/753 |
| 4,755,820 | 7/1988 | Backhouse et al. | 343/753 |

FOREIGN PATENT DOCUMENTS

| | | | |
|---|---|---|---|
| 0019047 | 2/1977 | Japan | 343/753 |
| 2044006 | 10/1980 | United Kingdom | 343/753 |

*Primary Examiner*—Rolf Hille
*Assistant Examiner*—Doris J. Johnson
*Attorney, Agent, or Firm*—Phillip J. McFarland; Richard M. Sharkansky

[57] ABSTRACT

An improved Lens/Polarizer/Radome system to modify the antenna pattern of an existing array antenna is shown to consist of a unitary assembly made up of a dielectric lens of appropriate shape, polarization determining means and absorbing means, such assembly being disposed to cover the aperture of the existing array antenna.

2 Claims, 2 Drawing Sheets

TABLE I

| P/N \ TOL | A ±.001 | B ±.001 | C ±.002 | D ±.003 | E ±.002 | F ±.002 |
|---|---|---|---|---|---|---|
| | ETCHED DIMENSIONS | | | | | |
| 19a,19e | .004 | .005 | .082 | .320 | .028 | .018 |
| 19b,19d | .006 | .006 | .125 | .320 | .045 | .0285 |
| 19c | .009 | .009 | .137 | .320 | .050 | .034 |

LENS/POLARIZER RADOME

This application is a continuation of application Ser. No. 270,450, filed November 7, 1988, now abandoned, which is a continuation of application Ser. No. 103,778 filed October 2, 1987, now abandoned.

BACKGROUND OF THE INVENTION

This invention pertains generally to directive antennas for radio frequency energy, and particualarly to a Lens/Polarizer/Radome used in conjunction with other types of antennas.

It is sometimes necessary to modify the shape of the antennas pattern of an array of antennas. In such case it would be standard practice to redesign the array to attain the desired modified antennas pattern. However, such an approach could be relatively difficult and expensive to implement, especially if implementation were to require retrofitting an appreciable number of systems in the field.

SUMMARY OF THE INVENTION

With the foregoing background in mind, it is a primary object of this invention to provide a Lens/-Polarizer/Radome that may be easily attached to an existing array antenna to modify the antenna pattern in a desired way without significantly affecting the other operating characteristics of such array antenna.

The foregoing and other objects of this invention are attained generally by providing a Lens/Polarizer/-Radome incorporating an appropriately shaped dielectric lens along with impedance matching and filtering structures such Lens/Polarizer/Radome being adapted for mounting on the existing array antenna to form a unitary structure.

BRIEF DESCRIPTION OF THE DRAWINGS

For a more complete understanding of this invention, reference is now made to the following description of the accompanying drawings wherein.

DESCRIPTION OF THE PREFERRED EMBODIMENT

Figure 1:
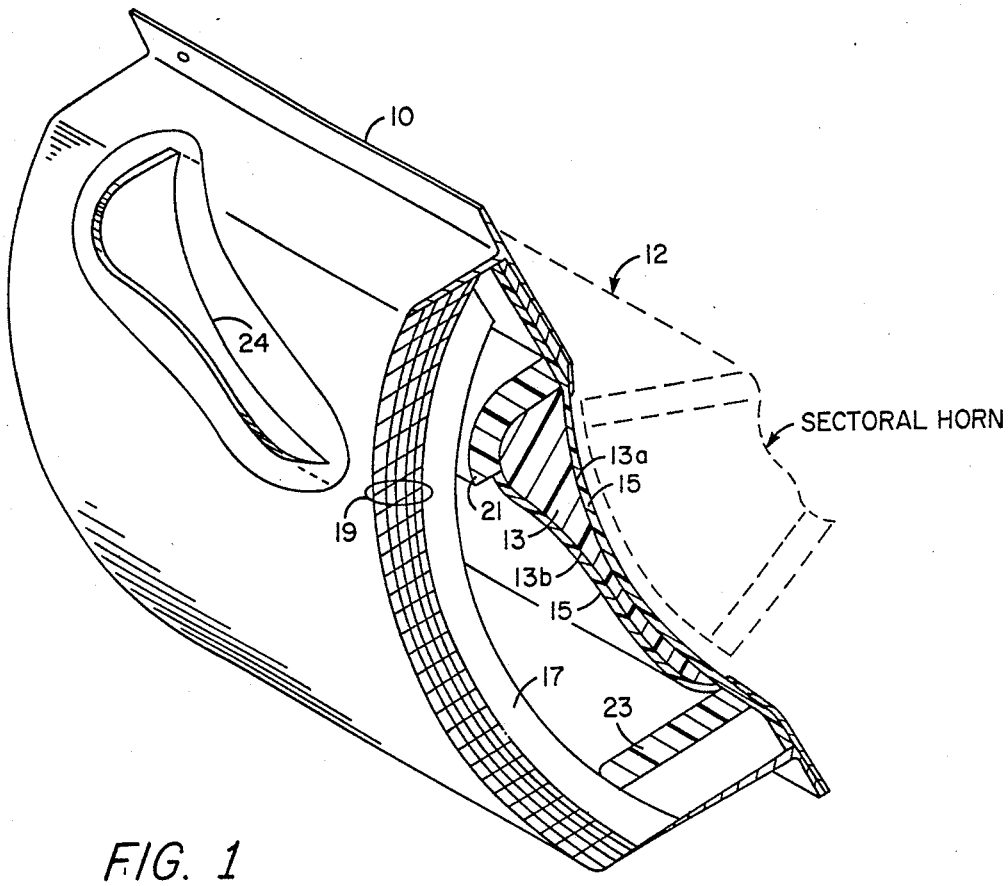
FIG. 1 is an isometric drawing, partially cross-sectional, showing a Lens/Polarizer/Radome according to a preferred embodiment of this invention in place over an array antenna.

Referring now to FIG. 1, it may be seen that the elements of the contemplated Lens/Polarizer/Radome are mounted within a flanged frame 10 that is dimensioned to permit mounting in any convenient manner on the face of an array antenna 12, here a linear array of sectoral horns (not numbered). The elements of the contemplated Lens/Polarizer/Radome are a dielectric lens 13, a quarter-wave matching element 15, a polarization filter 17 and a polarizer 19. In addition, absorbers 21, 23, 24 are provided as shown.

The dielectric lens 13, here fabricated from polyethylene having a dielectric constant of approximately 2.3, is shaped to have a first surface 13*a* complementary in shape to the ends of the sectoral horns (not numbered). To put it another way, first surface 13*a* is shaped to present nearly an equiphase surface to fields produced by the sectoral horns (not numbered). A second surface 13*b* of the dielectric lens 13 is shaped to adjust the phase delay of rays passing through the dielectric lens 13 as required to attain a desired distribution across the aperture (not numbered) of the Lens/Polarizer/Radome. As is known, the phase delay at any point through the dielectric lens 13 is directly related to the thickness of the dielectric lens and to the square root of the dielectric constant and inversely related to the wavelength of the electromagnetic energy being transmitted or received. In the illustrated example, where it is desired to increase the elevation angle of the upper 3 dB point of the antenna pattern, i.e., increase the coverage in elevation, the cross-section of the dielectric lens 13 is shaped as shown. It is noted here that the first surface 13*a* of the dielectric lens 13 need not be concentric with the end of the sectoral horns (not numbered). As a matter of face, in order to optimize elevation sidelobes it is here preferred that the dielectric lens 13 be rotated so that the upper end of the first surface 13*a* is slightly closer to the sectoral horn than the lower end of the first surface 13*b*.

The quarter-wave matching element 15 here is a sheet of foam rubber having a thickness of one-quarter wavelength of electromagnetic energy passing through the dielectric lens 13 in either direction. The dielectric constant of the foam rubber is equal approximately to the square root of the dielectric constant of the polyethylene of the dielectric lens 13. The quarter-wave matching element 15 is affixed with an electrically thin layer of R.F. transparent adhesive to the first and second surfaces 13*a*, 13*b* of the dielectric lens 13.

The polarization filter 17 and polarizer 19 here are used to convert circularly polarized energy to linearly polarized energy and vice versa and to compensate for changes in the cross-polarization component of the electromagnetic energy out of each sectoral horn (not numbered). As is known, such a cross-polarized component increases with non-principal plane angles. The polarization filter 17 is conventional, here being made up of parallel metal plates spaced at about 0.4 wavelengths at the upper end of the frequency band of interest and about $\frac{3}{4}$ inches deep. The polarization filter 17, as shown, conforms with the polarizer 19. On transmission, then, only horizontally polarized energy is passed through the polarization filter 17 to the polarizer 19.

Figure 2:
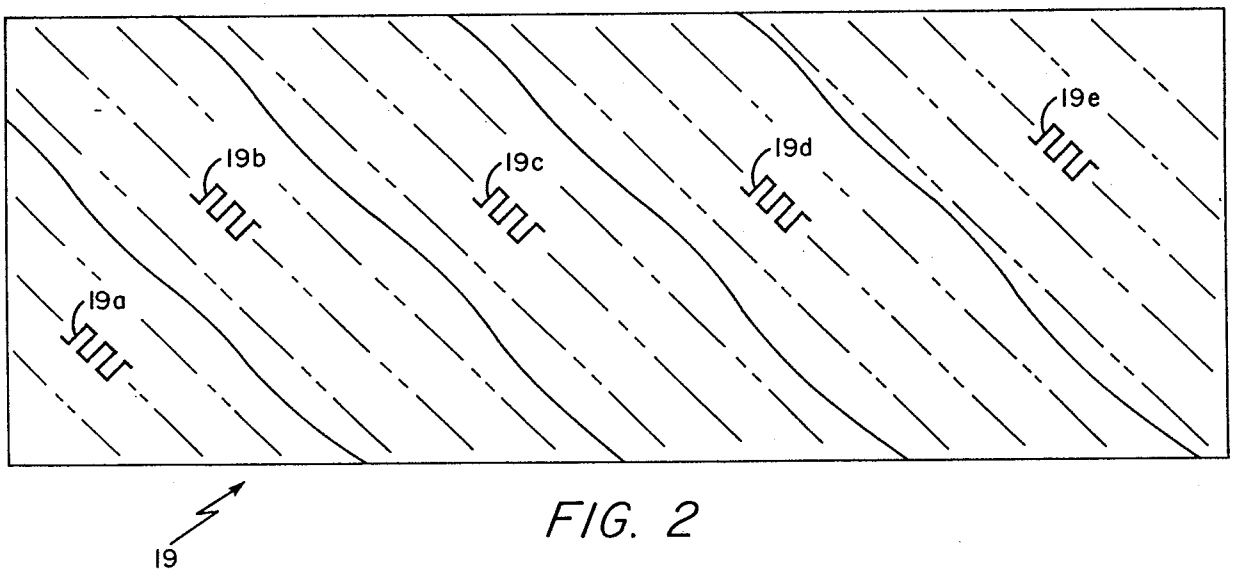
FIGS. 2 and 2A show a polarizer here contemplated.
Figure 2A:
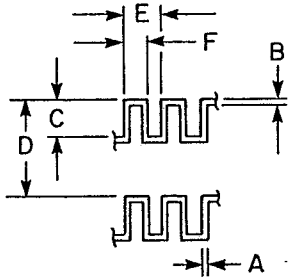

Referring now to FIGS. 2 and 2A, it will be seen that the polarizer 19 here consists of four sheets of dielectric material essentially transparent to the radio frequency energy passing through the Lens/Polarizer/Radome. Before assembly a metallic meanderline 19*a*, 19*b*, 19*c*, 19*d*, 19*e* is formed on each one of the sheets in accordance with the table shown in FIG. 2A. The meanderlines are oriented so that each is inclined at an angle of 45° to the horizontal. As a result, then, linearly polarized energy passing through the polarizer 19 is converted to circularly polarized energy. Because the polarizer 19 is a reciprocal device, circularly polarized energy passing through the polarizer 19 is converted to linearly polarized energy.

To complete the contemplated Lens/Polarizer/-Radome, absorbers 21, 23, 24 fabricated from any known absorbing material are affixed (as by cementing with an electrically thin layer of R.F. transparent adhesive) to the perimeter of the dielectric lens 13 and adjacent areas. The absorbers 21, 23, 24 then are effective to prevent unwanted nulls in the antenna pattern and radiation from the ends of the dielectric lens 13. In addition, spaces between the elements of the just-described Lens/Polarizer/Radome preferably are filled with dielectric material (not shown) having a dielectric constant approximating 1.0. Such a filler then has no appreciable electrical effect, but rather serves only to make the Lens/Polarizer/Radome a unitary structure.

Having described apparatus that may be used to implement the contemplated invention, it will now be apparent to one of skill in the art that modifications may be made without departing from the inventive concept. It is felt, therefore, that this invention should not be restricted to its disclosed embodiment, but rather should be limited only by the spirit and scope of the appended claims.

What is claimed is:

1. In an antenna system wherein the phase distribution of radio frequency energy across the aperture of an antenna array is to be changed from a first to a second phase distribution, the improvement comprising:

(a) a dielectric lens formed of a material having a dielectric constant greater than 2.0, such lens having a first side with a curvature substantially corresponding to the curvature of the aperture of the antenna array and a second side shaped to change the phase distribution of radio frequency energy from the first to the second phase distribution;

(b) impedance matching means overlying the first side of the dielectric lens and overlying the second side of the dielectric lens, such means being fabricated from a sheet of dielectric material having a dielectric constant substantially equal to the square root of the dielectric constant of the material of the dielectric lens and a thickness substantially equal to one-quarter wavelength of the radio frequency energy;

(c) absorbing means disposed around the periphery of the dielectric lens to control sidelobes and pattern nulls; and (d) supporting means for holding the lens, the impedance matching means and the absorbing means in the path of radio frequency energy passing to and from the aperture, the supporting means further being adapted to cause the first side of the lens to be tilted with respect to the aperture of the antenna array.

2. The improvement as in claim 1 adapted to transmit or receive circularly polarized radio frequency energy comprising:

(a) a polarization filter disposed in the path of radio frequency energy passing to and from the lens, such filter being effective to limit the plane of polarization of such energy to a predetermined plane; and (b) a polarizer disposed over the polarization filter to convert the polarization of energy originating at the aperture/to/circular polarization.

* * * * *